US007746319B2

(12) United States Patent
Yamaguchi et al.

(10) Patent No.: US 7,746,319 B2
(45) Date of Patent: Jun. 29, 2010

(54) IMAGE DISPLAY DEVICE

(75) Inventors: Yoshiro Yamaguchi, Ashigarakami-gun (JP); Yasufumi Suwabe, Ashigarakami-gun (JP); Yoshinori Machida, Ashigarakami-gun (JP); Motohiko Sakamaki, Ashigarakami-gun (JP); Takeshi Matsunaga, Ashigarakami-gun (JP); Atsushi Hirano, Ashigarakami-gun (JP); Kiyoshi Shigehiro, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1036 days.

(21) Appl. No.: 11/177,419

(22) Filed: Jul. 11, 2005

(65) Prior Publication Data

US 2006/0109236 A1 May 25, 2006

(30) Foreign Application Priority Data

Nov. 25, 2004 (JP) ..... 2004-339916

(51) Int. Cl.
*G09G 3/34* (2006.01)

(52) U.S. Cl. ..... 345/107; 345/204; 359/296

(58) Field of Classification Search ..... 345/107, 345/204; 359/296
See application file for complete search history.

(56) References Cited

U.S. PATENT DOCUMENTS 6,188,382 B1 * 2/2001 Okamura et al. ..... 345/669
6,628,257 B1 * 9/2003 Oka et al. ..... 345/97
6,667,732 B1 * 12/2003 Katase ..... 345/103
2002/0196219 A1 * 12/2002 Matsunaga et al. ..... 345/87
2004/0145696 A1 * 7/2004 Oue et al. ..... 349/167
2004/0239666 A1 * 12/2004 Yamaguchi et al. ..... 345/211

FOREIGN PATENT DOCUMENTS

JP 2001-312225 A 11/2001
JP 2004-45976 A 2/2004

* cited by examiner

*Primary Examiner*—Amr Awad
*Assistant Examiner*—Stephen A Bray
(74) *Attorney, Agent, or Firm*—Oliff & Berridge, PLC

(57) ABSTRACT

The present invention provides an image display device capable of freely changing a scanning direction of an image display medium including support plates, first and second electrode groups provided at the plates and colored particles provided between the plates, including first and second electrode-driving components which receive electrode-designation signals and apply voltages to the designated electrodes in the first and second electrode groups, and which can apply voltage to plural electrodes simultaneously, a line-image-data generation component which generates line-image-data for line images to be displayed along scan electrodes in accordance with a scanning direction, and a signal-output-destination-switching component, in accordance with the scanning direction, which outputs a first electrode designation signal for designating a scan electrode of a line image and a second electrode designation signal for designating an electrode to be driven for displaying the line image, to the first electrode driving component or the second electrode driving component.

16 Claims, 11 Drawing Sheets

FIG. 10

| ELECTRODE DIRECTION | SCANNING DIRECTION | DRIVING CIRCUIT FOR SCANNING | DRIVING CIRCUIT FOR DATA |
|---|---|---|---|
| FRONT FACE - HORIZONTAL | VERTICAL | 1 | 2 |
| FRONT FACE - HORIZONTAL | HORIZONTAL | 2 | 1 |
| FRONT FACE - VERTICAL | VERTICAL | 2 | 1 |
| FRONT FACE - VERTICAL | HORIZONTAL | 1 | 2 |

IMAGE DISPLAY DEVICE

CROSS-REFERENCE TO RELATED APPLICATION

This application claims priority under 35 USC 119 from Japanese Patent Application No. 2004-339916, the disclosure of which is incorporated by reference herein.

BACKGROUND OF THE INVENTION

1. Field of the Invention

The present invention relates to an image display device, and more specifically relates to an image display device which displays an image at a repeatedly rewritable image display medium which, by the application of voltages, moves colored particles between support plates for displaying the image.

2. Description of the Related Art

Heretofore, as repeatedly rewritable image display mediums with memory characteristics, image display mediums which employ colored particles (see, for example, Japanese Patent Application Laid-Open (JP-A) No. 2001-312225) and image display mediums which employ electrophoresis (see, for example, JP-A No. 2004-45976) have been known. Such an image display medium has a structure which includes, for example, a pair of plates (substrates) and particle groups of a number of varieties differing in color and electrostatic polarity, which are sealed between the plates to be movable between the plates by applied electric fields. Hence, the particles are moved by the application of voltages, which correspond to an image, between the pair of plates, and the image is displayed.

"Simple matrix driving" may be employed as a driving system of such an image display medium. In simple matrix driving, positions of intersection between, for example, a number of linear row electrodes provided at a display plate side of the image display medium and a number of linear column electrodes provided at a rear face plate side, which are perpendicular with the row electrodes, serve as pixel positions. Voltage is sequentially applied by a common driver IC to the column electrodes, which serve as scan electrodes, and, contemporaneously therewith, voltage is sequentially applied with a segment driver IC to the row electrodes, which serve as data electrodes, in accordance with a line image corresponding to the column electrode to which voltage is applied. Thus, an image is displayed.

At the common driver IC and the segment driver IC, the scanning directions of the electrodes are usually specified in advance. Thus, circuit structures are simplified and costs are reduced, and stable circuits with high output capabilities are structured.

Now, in an image display medium which employs colored particles as described above, a speed of response of the colored particles is slow, and when a line image corresponding to a column electrode that has been selected by the common driver is written by the row electrodes being sequentially scanned by the segment driver IC, a long scanning time is required, in comparison with liquid crystal devices. For example, a scanning time for a colored particle display medium is 1 to 10 ms/line, compared with 0.01 to 0.5 ms/line for a liquid crystal device. Accordingly, when a number of scanning lines is increased in order to raise resolution of images, the time to complete scanning of each frame is correspondingly lengthened. As a result, a user viewing the image display medium will be aware of directions of progress of scanning (in particular, a direction of sub-scanning) as directions of changes in rewriting of images.

A direction of reading of a document is generally determined by the document. For example, an English document is written horizontally from left to right, a Japanese document is written vertically from top to bottom, and an Arabic document is written horizontally from right to left. Directions of reading of information will also vary in accordance with arrangements of images, tables and the like.

A common driver IC and segment driver IC or the like which are employed in a liquid crystal device are structured such that scanning proceeds in essentially predetermined scanning directions. Consequently, scanning is always conducted in the same direction, regardless of details such as which direction the contents of the display will be read in. Hence, because a state of progress of scanning is more obvious with a display medium which employs colored particles than with liquid crystals or the like, a very irritating effect will be produced when, for example, scanning proceeds in the vertical direction during reading of a horizontally written document. This is not confined only to rewriting of display contents. An observer will also feel a sense of wrongness at a time of re-display for refreshing a display state.

Further, when a horizontally long display medium is turned to the left by 90° for use in a vertically long manner, if the medium has, for example, circuit structure such that a scanning direction sequentially scans toward the right before this rotation, scanning will be performed from bottom to top after the rotation, and a viewer's sense of wrongness will be greatly reinforced. In such circumstances, changing the driver IC, to which a large number of wires are connected, each time the orientation is changed would be difficult.

Accordingly, a display device which enables viewing by a viewer of a display medium employing colored particles without any sense of oddness, regardless of details of displays, orientation and the like, has been desired.

SUMMARY OF THE INVENTION

The present invention has been devised in consideration of the circumstances described above and provides an image display device which, in a case in which images are displayed at an image display medium which employs electrodes with a simple matrix structure, is capable of freely changing a scanning direction and the like.

An aspect of the present invention is an image display device including an image display medium on which an image is displayed, the image display medium including a pair of support plates, at least one of which is transparent, a first electrode group and a second electrode group, which are provided in respective correspondence with the pair of support plates, the first electrode group including plural linear first electrodes arranged side by side, and the second electrode group including plural linear second electrodes arranged side by side, which intersect the first electrodes, and colored particles sealed between the pair of support plates such that states of movement of the colored particles change in accordance with electric fields formed between the pair of support plates due to voltages applied to the first electrode group and the second electrode group, a first electrode driving component which receives an electrode designation signal, which designates an electrode belonging to the first electrode group to which voltage is to be applied, and applies voltage to the designated electrode, the first electrode driving component being capable of applying voltage to the plural first electrodes of the first electrode group at the same time, a second electrode driving component which receives an electrode designation signal, which designates an electrode belonging of the second electrode group to which voltage is to be applied, and applies voltage to the designated electrode, the second electrode driving component being capable of applying voltage to the plural second electrodes of the second electrode group at the same time, a line image data generation component to which image data of an image to be displayed at the image display medium is inputted, and which, using the image data, generates line image data for line images which are to be displayed along scan electrodes when the image of the image data is displayed by simple matrix driving, in accordance with a scanning direction when the image is displayed at the image display medium, and a signal output destination-switching component, in accordance with the scanning direction, which outputs a first electrode designation signal to one of the first electrode driving component and the second electrode driving component, for designating the scan electrode of the line at which the line image is to be displayed, and outputs a second electrode designation signal to the other of the first electrode driving component and the second electrode driving component, for designating an electrode to be driven for displaying the line image.

According to this invention, the image display medium displays an image by changing states of movement of the colored particles in accordance with electric fields, which are formed between the pair of support plates by voltages applied to the "simple matrix structure" electrodes.

The image display device, which displays images at this image display medium, is provided with the first electrode driving component, which applies voltage to the first electrodes and the second electrode driving component which applies voltage to the second electrodes. The first electrode driving component and the second electrode driving component are both structures which receive electrode designation signals, which designate electrodes belonging to the respective electrode groups to which voltages are to be applied, and apply voltage to the designated electrodes. Each component is capable of contemporaneously applying voltage to plural electrodes belonging to the respective group.

Thus, the driving components for driving the first electrodes and the second electrodes can each apply voltage to a number of electrodes at the same time. Therefore, each of the first electrodes and the second electrodes can serve as either scan electrodes or data electrodes.

The line image data generation component generates line image data, for images of lines which will be displayed along the scan electrodes when the image of the image data is displayed by simple matrix driving, in accordance with the direction of scanning when the image is displayed at the image display medium. The signal output destination-switching component is also provided. Depending on the scanning direction, the signal output destination-switching component outputs the first electrode designation signal, for designating the scan electrodes of the lines at which the line image data is to be displayed, to the one of the first electrode driving component and the second electrode driving component, and outputs the second electrode designation signal, for designating electrodes which are to be driven to display the line images, to the other of the first electrode driving component and the second electrode driving component.

Thus, it is possible to change the scanning direction for displaying images.

As has been described above, the present invention has the effects, in a case in which images are displayed at an image display medium which employs electrodes with a simple matrix structure, of enabling arbitrary changes in a scanning direction and the like and of enabling display-writing which will not cause irritation to a viewer.

BRIEF DESCRIPTION OF THE DRAWINGS

Embodiments of the invention will be described in detail with reference to the following figures, wherein:

FIG. 10 is a table showing correspondences between electrode direction, scanning direction and the like.

DETAILED DESCRIPTION OF THE INVENTION

Herebelow, embodiments of the present invention will be described in detail with reference to the drawings.

Figure 1A:
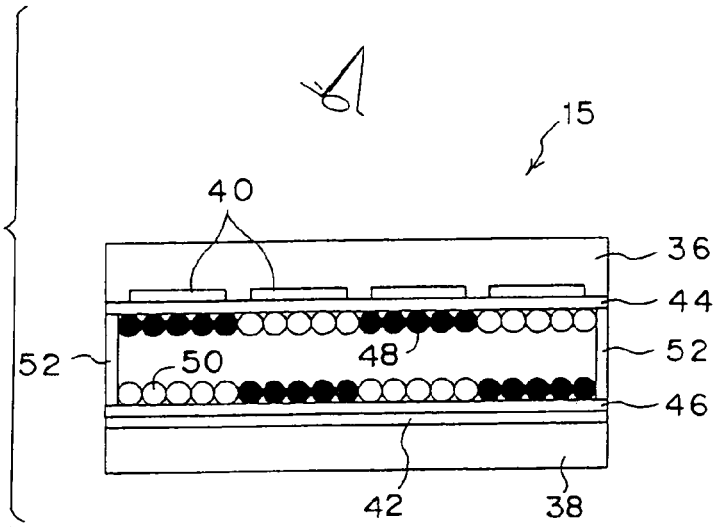
FIGS. 1A and 1B are sectional views of an image display medium.
Figure 1B:
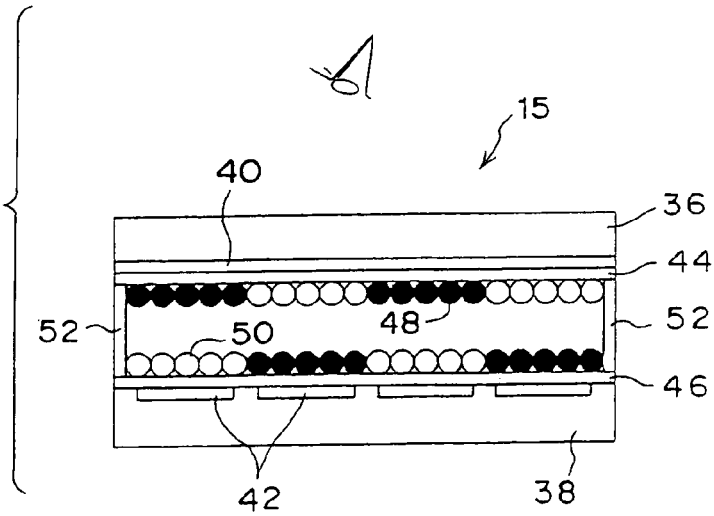
Figure 2A:
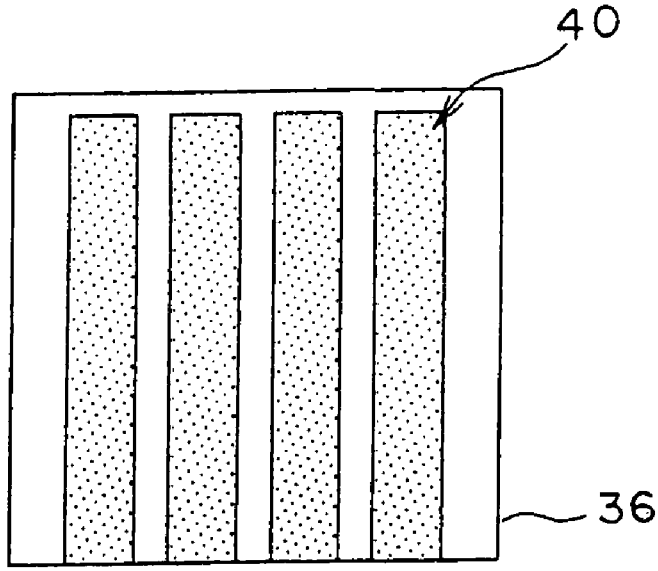
FIG. 2A is a plan view of a display support plate and FIG. 2B is a plan view of a rear face support plate.
Figure 2B:
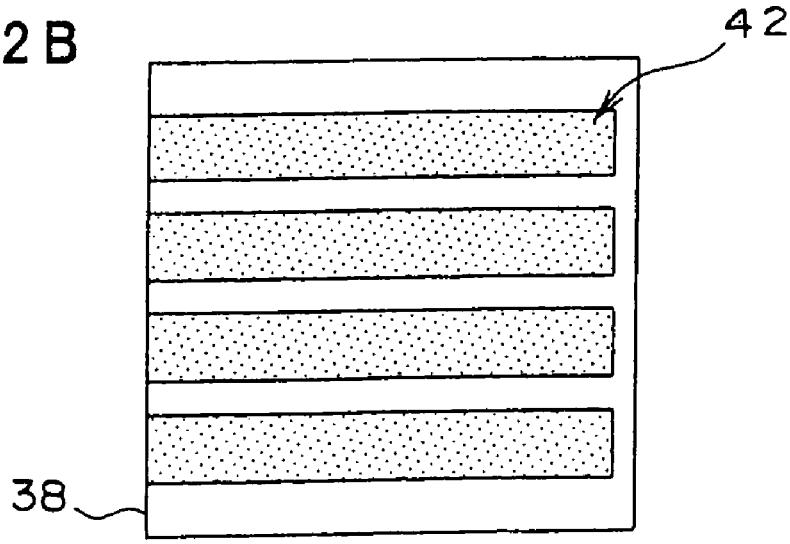

FIGS. 1A and 1B show sectional views of an image display medium 15 relating to a present embodiment. The image display medium 15 is provided with a transparent display support plate 36 and a rear face support plate 38. The display support plate 36 is at an image display side, and the rear face support plate 38 is disposed to oppose the display support plate 36 with a predetermined separation therebetween. FIGS. 2A and 2B show plan views of the display support plate 36 and the rear face support plate 38.

As shown in FIGS. 1A, 1B, 2A and 2B, a number (four in FIGS. 1A, 1B and 2A) of first electrodes 40 are formed at a face of the display support plate 36 at the side thereof which opposes the rear face support plate 38. Similarly, a number (four in FIGS. 1A, 1B and 2B) of second electrodes 42 are formed at a face of the rear face support plate 38 at the side thereof which opposes the display support plate 36. These are not referred to as column electrodes and row electrodes, as is conventional, because, as will be described below, either can serve as columns or rows in accordance with an orientation direction of the image display medium 15, a scanning direction and the like.

The display support plate 36 and the rear face support plate 38 are arranged to oppose one another such that the first electrodes 40 and the second electrodes 42 formed at the respective support plates intersect. The positions of intersection of the first electrodes 40 and the second electrodes 42 constitute pixels. Note that FIG. 1A is a sectional view of the image display medium 15 cut along the length direction of the second electrodes 42 and FIG. 1B is a sectional view of the image display medium 15 cut along the length direction of the first electrodes 40.

Here, in FIGS. 1A, 1B, 2A and 2B, a 4×4 simple matrix structure electrode layout is described for simplicity. Obviously however, in practice numbers of electrodes formed at support plates will correspond with numbers of pixels required for image display. That is, if m columns by n rows of pixels are required, n of the first electrodes 40 will be formed at the display support plate 36 and m of the second electrodes 42 will be formed at the rear face support plate 38.

The present embodiment has a structure in which the first electrodes 40 are formed at the display support plate 36 and the second electrodes 42 are formed at the rear face support plate 38. However, the second electrodes 42 may instead be formed at the display support plate 36, with the first electrodes 40 being formed at the rear face support plate 38.

An insulation layer 44 is formed at the first electrodes 40 side of the display support plate 36 and an insulation layer 46 is formed at the second electrodes 42 side of the rear face support plate 38. The insulation layers 44 and 46 are structured of, for example, a polycarbonate or the like.

Positively charged black particles 48 and negatively charged white particles 50, which are particle groups with mutually differing electrostatic polarities, are sealed between the display support plate 36 and the rear face support plate 38. Alternatively, the black particles 48 may be negatively charged and the white particles 50 positively charged. As the particles, for example, insulative particles, conductive particles and so forth may be employed.

A spacer member 52 is provided between the display support plate 36 and the rear face support plate 38. A gap between the display support plate 36 and the rear face support plate 38 is maintained at a constant separation by the spacer member 52. For the spacer member 52, a matrix-form structure may be employed such that the space between the support plates is divided up into individual pixels or sets of plural pixels. Thus, cells corresponding to the pixels are formed between the plates and movements of the particles are limited to within the respective cells. As a result, drifting of the particles can be prevented.

In the image display medium 15 which is structured thus, the black particles 48 and white particles 50 are moved between the plates by application of predetermined voltages, which are sufficient to generate a potential difference between the plates that is at least capable of moving the particles, between the first electrodes 40 and the second electrodes 42. For example, when predetermined voltages which will make potential of the first electrodes 40 positive with respect to the second electrodes 42 are applied between the first electrodes 40 and the second electrodes 42, the positively charged black particles 48 that are at the display support plate 36 side will move toward the rear face support plate 38 side, and the negatively charged white particles 50 that are at the rear face support plate 38 side will move toward the display support plate 36 side. On the other hand, when predetermined voltages which will make potential of the first electrodes 40 negative with respect to the second electrodes 42 are applied between the first electrodes 40 and the second electrodes 42, the negatively charged white particles 50 that are at the display support plate 36 side will move toward the rear face support plate 38 side, and the positively charged black particles 48 that are at the rear face support plate 38 side will move toward the display support plate 36 side.

Thus, by applying positive and negative predetermined voltages between the first electrode 40 and the second electrode 42 at positions corresponding to the pixel at which the particles are to be moved, the particles are moved in accordance with an image, and it is possible to display the image. Even after application of the voltages has stopped, the black particles 48/the white particles 50 remain adhered to the display support plate 36/the rear face support plate 38, by image force or the like, and display of the image is maintained.

The first electrodes 40 and second electrodes 42 may be formed, instead of at the opposing side faces of the display support plate 36 and the rear face support plate 38, at respective opposite side faces of the same, and may be respectively disposed as separate components outside of the display support plate 36 and the rear face support plate 38. In a case in which the electrodes are provided as separate components from the image display medium, the support plates may be structured by members having dielectric characteristics, and hence electric fields can be formed between the plates themselves.

Figure 8:
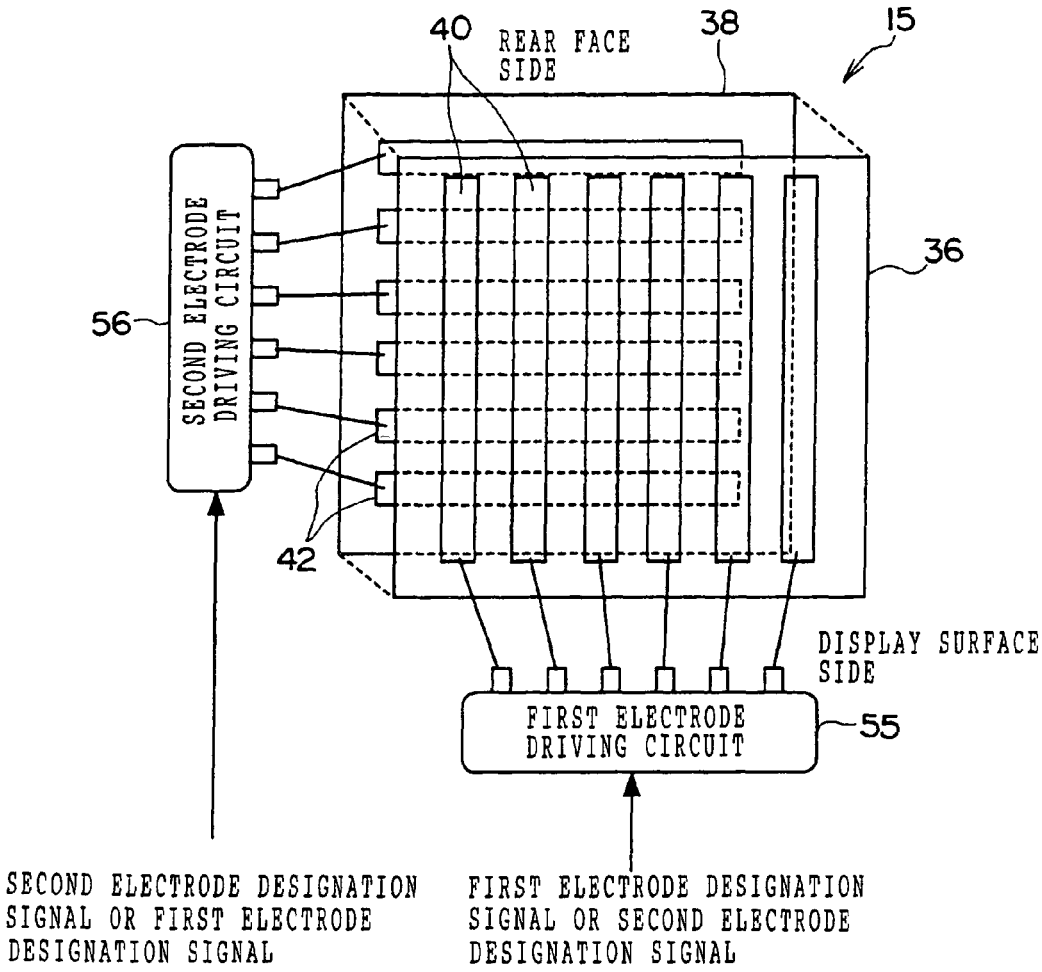
FIG. 8 is a schematic view showing an example of connections between the image display medium and driving circuits.

FIG. 8 shows a structural example of a state of connections between the first electrodes 40 and the second electrodes 42, which are formed on the display support plate 36 and the rear face support plate 38 of the image display medium 15 (6×6 pixels), and a first electrode driving circuit 55 and a second electrode driving circuit 56, which are connected to the first electrodes 40 and the second electrodes 42, respectively. These electrode driving circuits are structured by single or plural ICs. Obviously, it is also possible to employ an IC in which the first electrode driving circuit 55 and the second electrode driving circuit 56 are integrated together.

These electrode driving circuits must have the functionality of both a common driver for driving scan electrodes, which are common electrodes, and a segment driver for driving data electrodes. Accordingly, ICs, which are used as segment drivers, are employed for both of the electrode driving circuits.

The segment driver IC receives a power supply from a power source and generates a predetermined voltage to be applied to the first electrodes 40 or the second electrodes 42, and applies the generated predetermined voltage to the first electrodes 40 or the second electrodes 42. As a function of the segment driver, it is possible to apply voltage simultaneously to plural connected electrodes.

Figure 9:
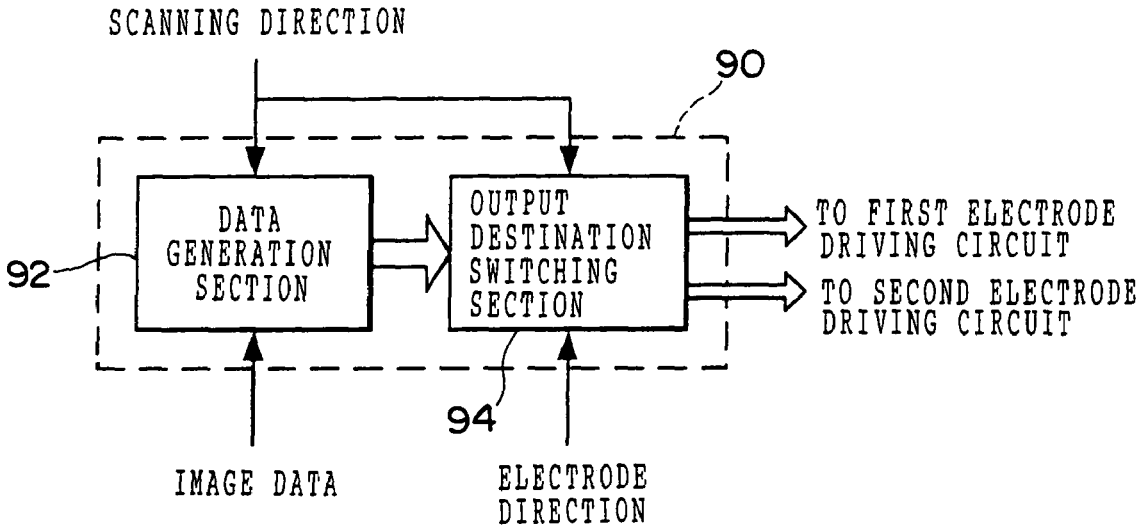
FIG. 9 is a block diagram showing an example of a driving device.

FIG. 9 exemplifies, in a block diagram, a portion of a driving device 90, which is for displaying an image at the image display medium 15 by scanning, in accordance with a scanning direction, on the basis of image data. The driving device 90 is structured to include a data generation section 92 and an output destination-switching section 94.

The data generation section 92 generates and outputs line image data and scan electrode designation information in accordance with the scanning direction. The line image data is generated from inputted image data. The scan electrode designation information designates scanning lines which the line image data represents.

The scanning direction may be specified each time an image is written, or may be pre-specified before generation of line image data and the like and memorized at an unillustrated memory. For example, at a structure with a fixed orientation in which the image display medium 15 is not turned, the scanning direction is to be changed from vertical (from top to bottom) to horizontal (from right to left). In this case, information is stored in the memory which designates which of first electrode designation signals, for designating scan electrodes for lines at which the line image data is to be displayed, and second electrode designation signals, for designating data electrodes which are to be driven for displaying the line image, is to be outputted to the first electrode driving circuit 55 and which of the same is to be outputted to the second electrode driving circuit 56. That is, scanning direction designation information for designating the scanning direction is stored in the memory. A non-volatile memory may be used for this memory. It is also possible to provide an electronic switch, and set the scanning direction by on and off states of this switch. Alternatively, there is a method in which scanning sequence designation information representing a sequence (an order) of scanning is received together with the image data, and the scanning sequence designation information is separated from the image data. This will be discussed later.

Now, if the scanning direction is simply continuous scanning in one direction, the scanning sequence selects adjacent scanning lines in order. Accordingly, the data generation section 92 sequentially outputs only each line image data in scanning direction, which is generated in accordance with the scanning direction. Alternatively, the data generation section 92 may output image data to an unillustrated image display memory, at which scan electrode positions have been specified with reference to memory addresses beforehand. Hence, the output destination-switching section 94, which will be described later, can, on the basis of separately acquired scanning direction designation information, read out line image data for the corresponding addresses.

Next, an example of a process for generating line image data with the data generation section 92 will be described. First, resolution of inputted image data and a resolution which can be displayed by the image display medium 15 are compared, and the image data is enlarged or reduced to a resolution to be displayed by the image display medium 15. At this time, as necessary, data interpolation, smoothing and the like may be performed, and display image quality can be enhanced. Subsequently, on the basis of information designating the scanning direction, line image data to be displayed by scan electrodes is extracted. For example, in a case of sub-scanning in the vertical direction, the main scanning direction is the horizontal direction. Thus, as horizontal line image data, extracting is carried out sequentially in the order from a top point of the image data that has been magnified/reduced. Alternatively, if the main scanning direction is the vertical direction, vertical line image data is sequentially extracted. The line image data is outputted to the output destination-switching section 94 together with scan electrode designation information representing the scan electrodes of the lines that are to display the line image data.

Next, on the basis of the scanning direction designation information stored in the memory, the output destination-switching section 94 judges whether the electrodes group corresponding to the scanning direction will be the first electrodes 40 or the second electrodes 42. Then, on the basis of this judgment, the output destination-switching section 94 switches the electrode driving circuits that are to output the inputted line image data and scanning sequence data, outputs the first electrode designation signals for designating the scan electrodes to the electrode driving circuit that is to drive the scan electrodes, and outputs the second electrode designation signals to the electrode driving circuit that is to drive the data electrodes, such that voltage application will be performed in accordance with the line images to be displayed along the scan lines.

As shown by the example in FIG. 10, correspondences between information concerning electrode direction, the scanning direction, the scanning driving circuit, and the data driving circuit are stored in the memory. Whether the electrode group corresponding to the designated scanning direction is the first electrodes 40 or the second electrodes 42 can be determined on the basis of these correspondences. In the example shown in FIG. 10, it is shown that, if the electrode direction is "front face—horizontal" and the scanning direction is "vertical", the first electrode driving circuit 55 is the scanning driving circuit and the second electrode driving circuit 56 is the data driving circuit.

Now, if the orientation is fixed and the arrangement of the image display medium 15 will not be rotated, the electrode direction may be specified in advance. In a case in which the arrangement of the image display medium 15 may be rotated, orientation direction information relating to a direction of orientation of the image display medium 15, such as horizontal, vertical or the like, may be stored in the memory and the electrode directions are distinguished by reference to this information. Further, in addition to a case in which the arrangement of the image display medium 15 may be rotated, it is possible to alter the scanning direction in accordance with the image information that is to be displayed. Accordingly, it is possible to add information representing correspondences as shown in FIG. 10 to the image data, to regulate the scanning direction so as to, for example, scan from the right for vertically written text information or scan from the top for horizontally written text information.

Now, in the case of a structure in which the data generation section 92 in a sequence manner outputs only each line image data in the scanning direction as mentioned above, the data generation section 92 may be structured so as to, on the basis of the scanning direction designation information, output the first electrode designation signals, for sequentially selecting the scan electrodes, to the one of the first electrode driving circuit 55 and the second electrode driving circuit 56 that is to drive the scan electrodes and sequentially output the second electrode designation signals, for instructing voltage application for the line image data corresponding to the scan electrodes, to the electrode driving circuit that is to drive the data electrodes. Here, the data output destination-switching section 94 may access a memory device or setting device or the like to acquire the scanning direction designation information, and may acquire the scanning direction designation information from the data generation section 92.

In accordance with the scanning direction, the first electrode driving circuit 55 and second electrode driving circuit 56, to which the scan electrode designation information is inputted as the first electrode designation signals and the line image data is inputted as the second electrode designation signals, apply voltages to the designated electrodes, and the colored particles that are between the electrodes are caused to move. By performing this operation for required scan electrodes, the image is displayed.

In order to display an image between two electrodes, voltages are applied to the first electrode 40 and the second electrode 42 such that a potential difference (or electric field strength) between the first electrode 40 and the second electrode 42 generates an electric field equal to or greater than a threshold electric field for moving the particles.

Examples of displaying image of the present invention include, beside the case described above, cases in which vertical/horizontal text information is mixed in with image information, cases which are only partially text information and so forth. Further, with the present invention, it is possible to implement changes in scanning direction during writing of individual images, which is a method for attracting the attention of viewers to mediums which are public notices or commercial messages.

As described above, with this embodiment, it is possible to easily alter the scanning direction in accordance with requirements, and it is possible to implement displays appropriate to various kinds of viewing.

Figure 3:
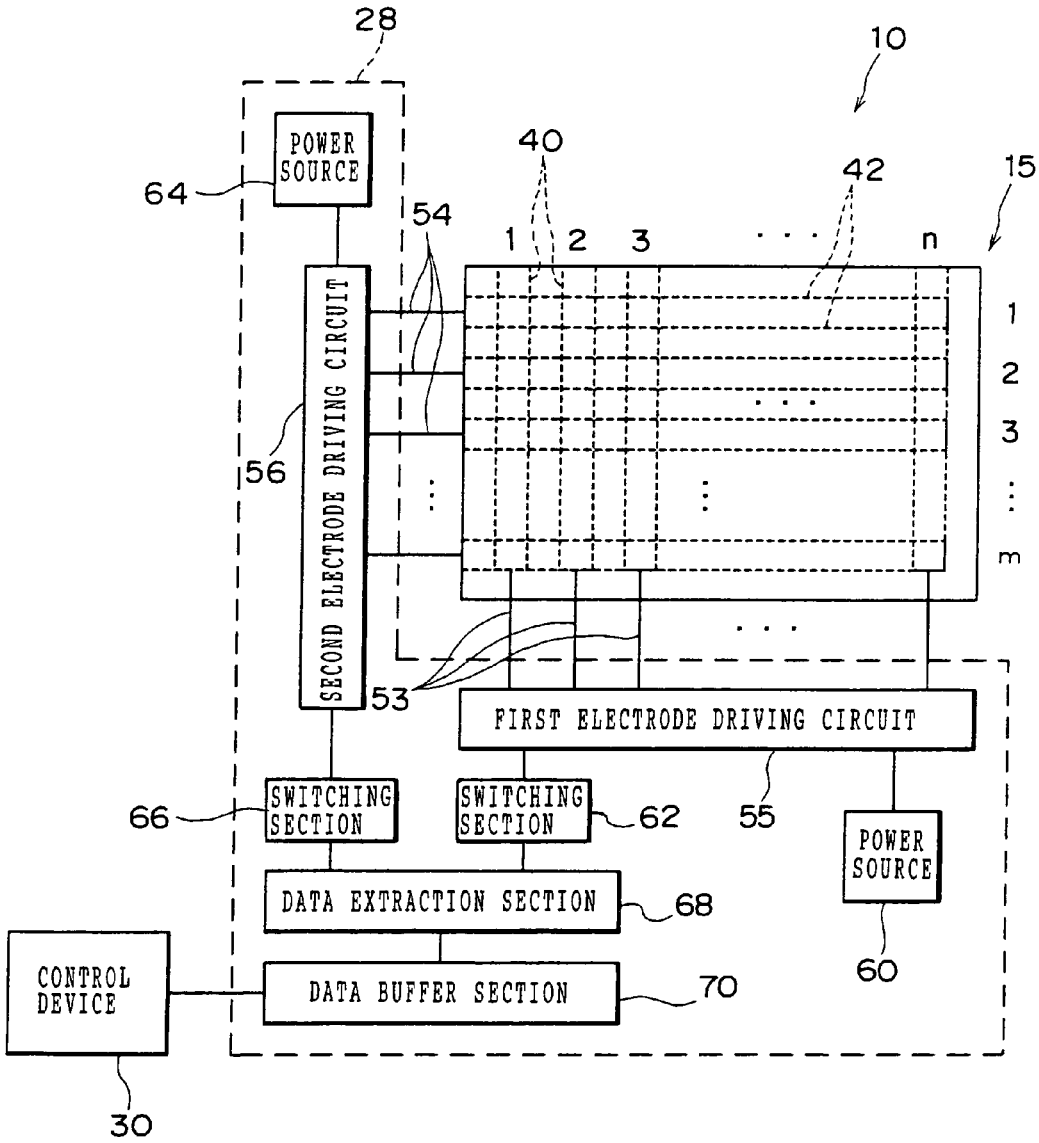
FIG. 3 is a schematic structural view of an image display device.

Next, as a second embodiment, an example will be described of a structure for enabling more flexible image display. FIG. 3 shows a structural block diagram of an image display device 10. As shown in FIG. 3, the image display device 10 is structured with the image display medium 15, a driving device 28 and a control device 30.

The image display medium 15 has a structure, which can be removably mounted, at the driving device 28, and with which it is possible to alter a mounting orientation. When the image display medium 15 is mounted at the driving device 28, the first electrodes 40 of the display support plate 36 are connected to first electrode wiring 53 and the second electrodes 42 of the rear face support plate 38 are connected to second electrode wiring 54. Hence, the first electrodes 40 are connected to the first electrode driving circuit 55 and the second electrodes 42 are connected to the second electrode driving circuit 56.

The first electrode driving circuit 55 is connected to a power source 60 and a converting section 62. The first electrode driving circuit 55 receives a power supply from the power source 60, generates a predetermined voltage to be applied to the first electrodes 40, and applies the generated predetermined voltage to the first electrodes 40. Here, the first electrode driving circuit 55 is capable of applying voltage to a plurality of the first electrodes 40 at the same time, and applies voltage to the first electrodes 40 that have row numbers designated by the converting section 62.

The second electrode driving circuit 56 is connected to a power source 64 and a converting section 66. The second electrode driving circuit 56 receives a power supply from the power source 64, generates a predetermined voltage to be applied to the second electrodes 42, and applies the generated predetermined voltage to the second electrodes 42. Here, the second electrode driving circuit 56 is capable of applying voltage to a plurality of the second electrodes 42 at the same time, and applies voltage to the second electrodes 42 that have column numbers designated by the converting section 66.

Thus, the second electrode driving circuit 56 is not a scanning-dedicated driving circuit for which the scanning direction is fixed as is conventional but, similarly to the first electrode driving circuit 55, has a structure which is capable of applying voltage to plural electrodes simultaneously. Therefore, either of the first electrode driving circuit 55 and the second electrode driving circuit 56 can be used for scanning or for data, and it is possible to cope with changes in scanning direction, changes in orientation of the image display medium 15 and the like.

It is preferable if absolute values of the predetermined voltage outputted by the first electrode driving circuit 55 and the predetermined voltage outputted by the second electrode driving circuit 56 are the same. For example, in a case in which a voltage which will initiate movement of the particles is 70 V, circuits which output voltages of ±50 V are employed for both the first electrode driving circuit 55 and the second electrode driving circuit 56. In such a case, with the respective electrodes corresponding to the position of a pixel at which the particles are to be moved, it is possible to generate a potential difference of 100 V at that position and move the particles by the first electrode driving circuit 55 applying a voltage of −50 V (or +50 V) and the second electrode driving circuit 56 applying a voltage of +50 V (or −50 V).

As in the prior art, if voltages with different absolute values are applied by a second electrode and a first electrode, as in, for example, the case of a structure which applies a voltage of ±70 V to a second electrode and ±30 V to a first electrode, the potential difference at a position at which the particles are not intended to be moved may be as high as 70 V, and it will be close to the voltage which initiates movement. In such a case, particles may move at pixels at which movement is not required, which can result in image deterioration.

In contrast, when the absolute values of voltages outputted by the first electrode driving circuit 55 and the second electrode driving circuit 56 are equal, it is possible to more reliably ensure that particles at positions at which movement is not particularly required will not move. In addition, because it is possible to use the same driving circuits, costs can be kept down.

The converting sections 62 and 66 are connected to a data extraction section 68, and the data extraction section 68 is connected to a data buffer section 70.

Figure 4:
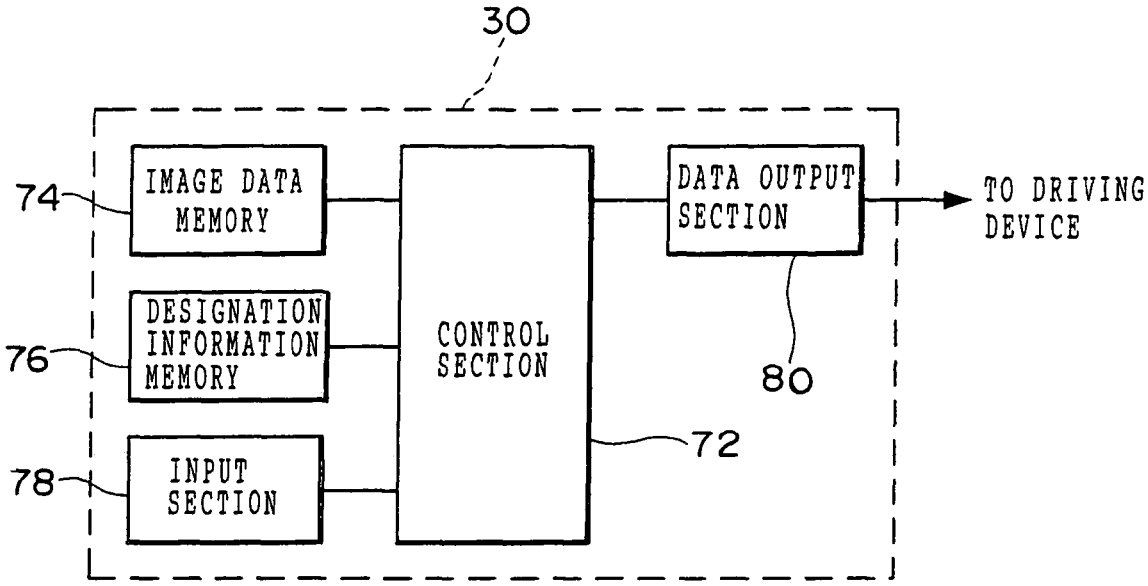
FIG. 4 is a schematic block diagram of a control device.

As shown in FIG. 4, the control device 30 is structured to include a control section 72, an image data memory 74, a designation information memory 76, an input section 78 and a data output section 80.

The image data memory 74 stores image data of an image that is to be displayed at the image display medium 15. The designation information memory 76 stores the scanning direction designation information for specifying which of the second electrodes 42 and the first electrodes 40 are the scan electrodes, that is, the scanning direction, and addressing data which serves as scanning sequence designation information for assigning an order of scanning of the electrodes designated as the scan electrodes. These data can be written by input from the input section 78.

Figure 5:
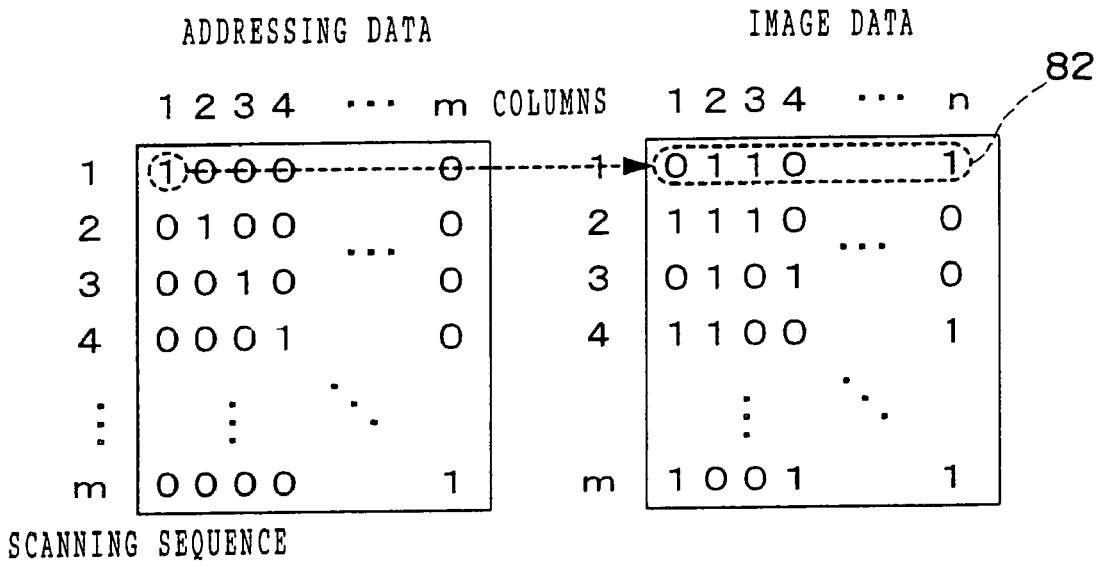
FIG. 5 is a diagram showing an example of structures of addressing data and image data.

FIG. 5 shows an example of addressing data and binary image data for a case in which the scanning direction designated by the scanning direction designation information is the vertical direction; that is, the second electrodes 42 are the scan electrodes.

As shown in FIG. 5, the addressing data in the case in which the second electrodes 42 are designated as the scan electrodes is constituted by m×m bits of data, corresponding to the number of the second electrodes 42. The scanning sequence (voltage application sequence) is designated by the m bits in the vertical direction, and column numbers of the second electrodes 42 that are to be applied voltages are designated by the m bits in the horizontal direction. Herebelow, the m bits of data in the horizontal direction, which specify column numbers, are referred to as column number designation data. Here, as an example, the column numbers are 1 to m in order from the top, as shown in FIG. 3.

The addressing data in a case in which the first electrodes 40 are designated as the scan electrodes will be constituted by n×n bits of data, corresponding to the number of the first electrodes 40. The scanning sequence (voltage application sequence) is designated by the n bits in the vertical direction, and row numbers of the first electrodes 40 that are to be applied voltages are designated by the n bits in the horizontal direction. Herebelow, the n bits of data in the horizontal direction, which specify row numbers, are referred to as row number designation data. Here, as an example, the row numbers are 1 to n in order from the left, as shown in FIG. 3.

In the case in which the scan electrodes are the second electrodes 42, the column number designation data is set to on, i.e., '1', for bits corresponding to the column numbers of columns which include pixels at which particles are to be moved, and is set to off, i.e., '0', for other columns. For example, in the column number designation data for a first scan in the example of FIG. 5, the first bit is on, meaning that the first column, the second electrodes 42 is assigned to be applied voltage. Similarly, for second to m-th scans, the second to m-th columns, the second electrodes 42 are sequentially assigned to be applied voltage. In other words, the addressing data shown in FIG. 5 is constituted so as to sequentially apply voltages from a first column second electrode to an m-th column second electrode, similarly to conventional simple matrix driving.

Here, if there is a column which does not include any pixels at which the particles are to be moved, that is, if there is a column which does not require writing, bits corresponding to the column number of that column are all set to '0'. In the example shown in FIG. 6, column data of a second column of the image data is entirely '0', and there is no need to write an image at that column. In this case, bits of the addressing data for which the column number is '2' are all set to '0'.

When an image is to be displayed at the image display medium 15, the control section 72 reads image data from the image data memory 74, reads scanning direction designation information and addressing data from the designation information memory 76, and outputs the image data, the scanning direction designation information and the addressing data to the data output section 80.

The data output section 80 gathers together the inputted image data, scanning direction designation information and addressing data, and outputs the data to the driving device 28.

The driving device 28 stores the various data outputted from the control device 30 in the data buffer section 70.

The data extraction section 68 extracts data to be outputted to the respective converting sections 62 and 66 on the basis of the various data stored in the data buffer section 70. Then, the data extraction section 68 outputs the extracted data to the respective converting sections 62 and 66.

Specifically, the data extraction section 68 refers to the scanning direction designation information and, for the converting section 66 corresponding with the electrodes designated as scan electrodes (here, the second electrodes 42), extracts data, from addressing data, in sequence from the column number designation data of the first time of the scanning sequence, and outputs the extracted data to the converting section 66.

At the same time, for the converting section 62 corresponding with the electrodes which are not designated as scan electrodes (below referred to as data electrodes), i.e., the first electrodes 40, the data extraction section 68 extracts column data, corresponding to a bit that is set to on in the column number designation data, from the image data and outputs this extracted data to the converting section 62.

For example, in the example of FIG. 5, the first bit of the first time of column number designation data is set to on. Therefore, a first column of column data 82 is extracted from the image data and outputted to the converting section 66. Thereafter, column data from the second column to the m-th column is outputted to the converting section 66 in sequence.

Figure 6:
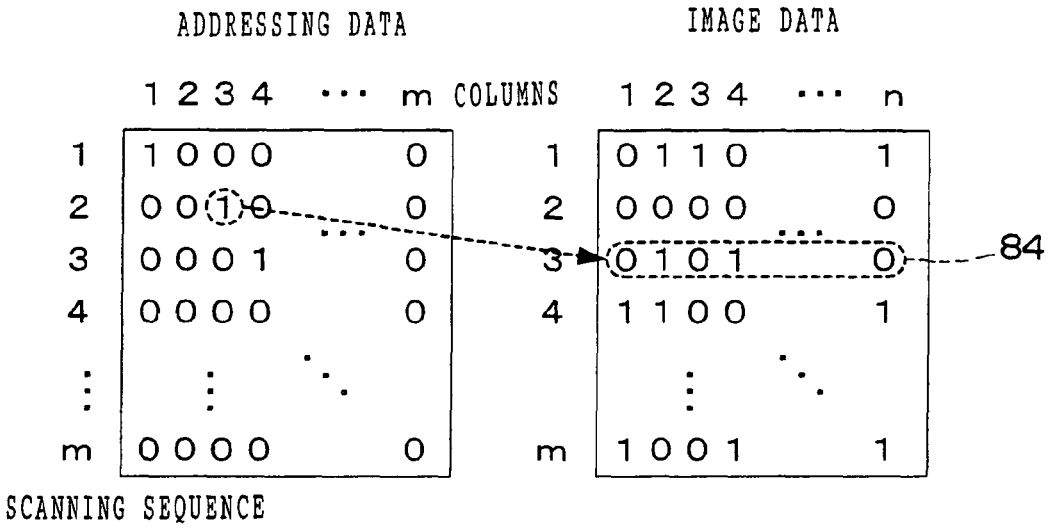
FIG. 6 is a diagram showing another example of structures of addressing data and image data.

Further, in the example of FIG. 6, the first bit of the first time of column number designation data is set to on. Therefore, a first column of column data is extracted from the image data and outputted to the converting section 62. However, in the second time of column number designation data, the third bit is set to on. Therefore, the second column of column data is not outputted to the converting section 62, a third column of column data 84 is outputted to the converting section 62. When columns for which writing of an image is not required are skipped in this manner, the number of scanning times is correspondingly reduced, and unnecessary scanning can be eliminated.

The converting section 66 outputs all column numbers of columns corresponding to bits that are set to on in the inputted column number designation data to the second electrode driving circuit 56. Accordingly, the second electrode driving circuit 56 applies the predetermined voltage to all of the second electrodes 42 of the designated column numbers.

Meanwhile, the converting section 62 outputs all row numbers of rows corresponding to bits that are set to on in the inputted column data to the first electrode driving circuit 55. Accordingly, the first electrode driving circuit 55 applies the predetermined voltage to all of the first electrodes 40 of the designated row numbers. Here, operations of the converting sections 62 and 66 are executed contemporaneously.

When such operations are sequentially executed in accordance with the scanning sequence, sequential display of images of the designated columns proceeds, and display of the overall image is complete when scanning finishes.

Thus, the present embodiment employs the first electrode driving circuit 55 and the second electrode driving circuit 56, which are each capable of applying voltage to plural electrodes simultaneously, and has a structure which determines electrodes that are to be applied voltage on the basis of addressing data. Therefore, the present embodiment is not fixed with a scanning method in which voltage is applied in order from a first column second electrode, as is conventional, and can be employed with various scanning methods. It is possible to perform writing of images with various methods, such as, for example, changing scanning direction, applying voltage to a number of the second electrodes and a number of the first electrodes at the same time for writing a predetermined region all at once, and so forth.

For example, in a case in which it is desired to change the scanning direction from the direction from the first column to the m-th column to the direction from the m-th column to the first column, in the opposite way of the addressing data of FIG. 5, it may be done with the m-th bit of the column number designation data of the first time of the scanning sequence of the addressing data, the (m−1)-th bit of the column number designation data of the second time of the scanning sequence, . . . and the first bit of the column number designation data of the m-th time of the scanning sequence each being set to '1'.

Further, in a case in which it is desired to write to plural columns of the image simultaneously, the column number designation data may be set to '1' at all bits corresponding to columns for which writing is desired.

Figure 7:
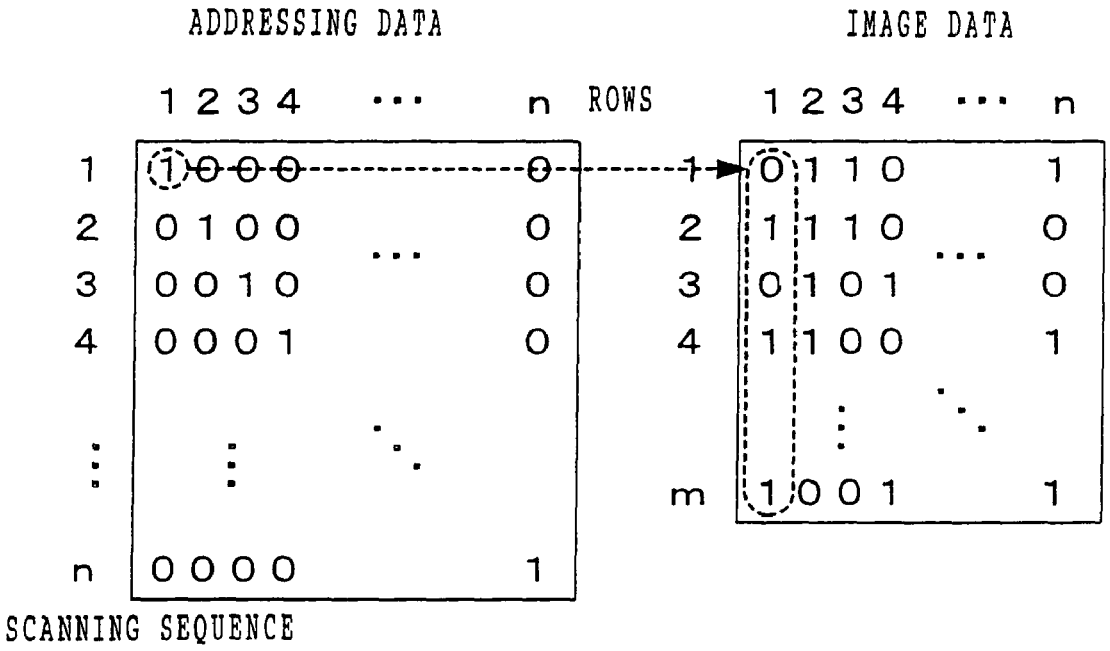
FIG. 7 is a diagram showing yet another example of structures of addressing data and image data.

Further again, in a case in which it is desired to change the scan electrodes to the first electrodes 40, the scanning direction designation information designates the horizontal direction and, as shown in FIG. 7, n×n bits of addressing data, corresponding to the number of the first electrodes 40, are prepared. In this case, the data extraction section 68 extracts row data of designated row numbers from the image data and outputs the row data to the converting section 66. For example, when the first bit of the first time of the row number designation data is set to on, a first row of the row data 86 is outputted to the converting section 66. Hence, writing of the image can be implemented with the first electrodes 40 serving as the scan electrodes.

Further yet, in a case in which the image display medium 15 is removed from the driving device 28, the horizontal/vertical orientation is changed and the image display medium 15 is re-mounted, it is possible to cope with this with ease, by preparing the addressing data accordingly.

Now, the present embodiment has been described for a case in which binary images based on binary image data are to be displayed at the image display medium 15. However, the present invention is not limited thus, and can be applied to cases in which multi-level images based on multi-level image data with plural bits assigned to each pixel are to be displayed at the image display medium 15.

In such a case, the converting sections 62 and 66 are provided with a lookup table representing correspondences between the multi-level data and voltage values for application voltages. For example, in the case of four values, voltage values of application voltages can be found in correspondence with values '0' to '3' in a lookup table. Thus, the converting section 62 or 66 finds a voltage value of an application voltage that corresponds to multi-level data included in column data or row data inputted from the data extraction section 68 from the lookup table, and outputs the voltage value to the second electrode driving circuit 56 or first electrode driving circuit 55 together with the column number or row number to which the voltage is to be applied. Otherwise, this case is similar to the descriptions above. Thus, it is possible to display a multi-level image at the image display medium 15.

Note that image display mediums which employ particles are not limited to structures in which densities of images are controlled by voltage values of applied voltages. Densities can also be controlled by pulse widths, pulse counts and the like of applied voltages. Lookup tables representing correspondences between such factors and multi-level data may be used for control in such cases.

The present invention can also be applied to image display mediums which are capable of displaying color images. In such a case, electrodes are provided at the image display medium to correspond to the respective colors. Hence, addressing data designating the sequence of application of voltages to the electrodes may be prepared in the same manner as described above, and operations may be performed in the same manner as described above.

Figure 11A:
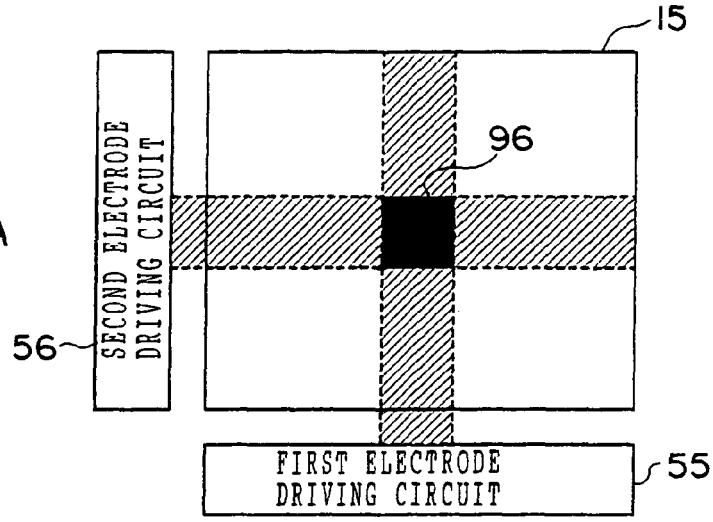
FIGS. 11A, 11B and 11C are views showing an example of image display.
Figure 11B:
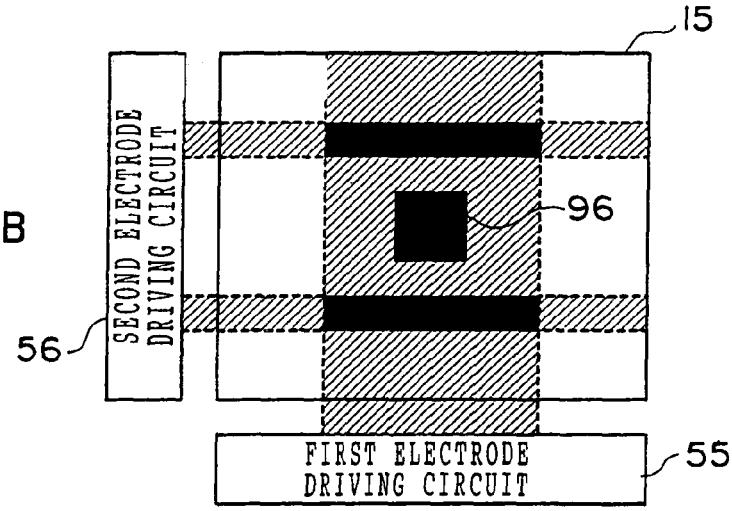
Figure 11C:
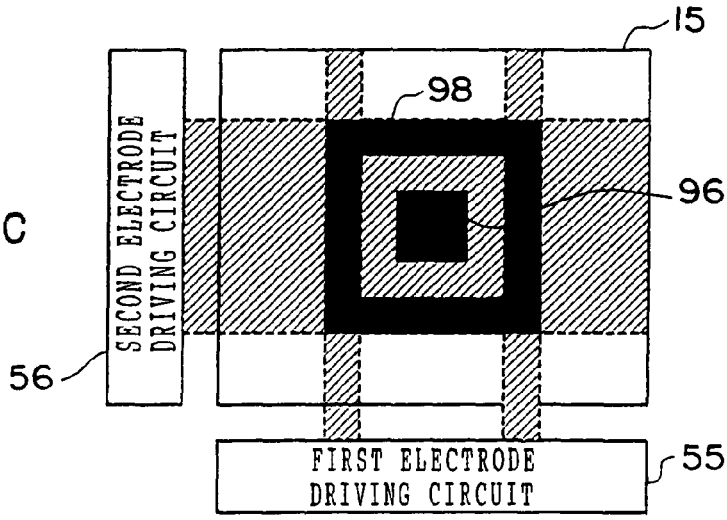

Furthermore, because it is possible to arbitrarily select plural electrodes in the image display device of the present embodiment, various image display controls are possible. As an example, as shown in FIG. 11A, the first electrode driving circuit 55 and the second electrode driving circuit 56 first apply voltages simultaneously to electrodes of the shaded regions of the drawing such that a square-shaped image 96 is displayed at the middle of the image display medium 15. Then, the first electrode driving circuit 55 and second electrode driving circuit 56 simultaneously apply voltages to the electrodes of the shaded regions shown in FIG. 11B, and then apply voltages simultaneously to the electrodes of the shaded regions shown in FIG. 11C. As a result, a rectangular ring-like image 98 is formed around the image 96. It is possible to display an animation-style image by writing again the central image 96 to display after this image 98 has been displayed.

Note that, although the present embodiment has been described for a case of a structure in which the image display medium 15 is mountable at and removable from the driving device 28, the present invention is not limited thus. The image display medium 15, the first electrode driving circuit 55 and the second electrode driving circuit 56 may be integrated to form a structure which can be mounted at the driving device 28 and whose vertical/horizontal orientation can be changed with mounting. In such a case too, it is possible to display images appropriately by changing the addressing data.

Further, the present embodiment has been described for a case of application of the present invention to an image display device that displays images at an image display medium which employs particles. However, the present invention can also be applied to image display mediums which employ electrophoresis and the like.

In the aspect of the present invention, it is possible that the line image data generation component outputs scan electrode designation information for designating the scan electrode of the line at which the line image is to be displayed, and the signal output destination-switching component outputs the first electrode designation signal on the basis of the scan electrode designation information. With such a structure, display of images with various methods, such as changing the scanning direction, skipping scans, image-writing only a predetermined region and the like, are enabled.

Herein, in the aspect of the invention, it is possible that scanning direction designation information is stored at the signal output destination-switching component before input of the image data to the line image data generation component, the scanning direction designation information designating, in accordance with the scanning direction, which of the first electrode driving component and the second electrode driving component is the electrode driving component to which one of the first electrode designation signal and the second electrode designation signal is outputted.

Further, in the aspect of the present invention, it is possible that orientation direction information, for specifying orientation directions of the electrode groups on the support plates that are positioned at a front face side and a rear face side of the image display medium, is stored at the signal output destination-switching component, and the electrode groups to which voltages are applied on the basis of the first electrode designation signal and the second electrode designation signal are switched in accordance with the orientation direction information and the scanning direction.

For example, if an image display medium is to be used with the orientation changing, information specifying an orientation direction can be stored in advance. The information specifying the orientation direction could be, for example, simply the directions of electrode groups at the front face side and rear face side, and could be the directions of electrode groups at the front face side and rear face side which are read by assignment of an orientation direction of the image display medium. As a result, the electrode designation signals (voltages are applied to the electrode groups of the scan electrodes and data electrodes on the basis of the first electrode designation signal and the second electrode designation signal) are switched. Hence, it is possible to change the scanning direction, scanning sequence and the like more easily.

In the aspect of the present invention, it is possible that scanning sequence designation information, which relates to a scanning sequence of plural electrodes belonging to the electrode group that is to serve as the scan electrodes, is inputted to the line image data generation component, and the scan electrode designation information is generated on the basis of the scanning sequence designation information.

The scanning sequence designation information may include, in association with the specification of a scanning direction, designation of a sequence for selecting, in a continuous manner or in an intermediate manner, scan electrodes from an electrode at one end to an electrode at another end, a designation for selecting sequentially from a certain electrode to another electrode in order to write and display only to a partial region of an electrode group, and so forth.

Alternatively, in the aspect of the present invention, it is possible that plural electrodes from the electrode group designated as the scan electrodes can be designated to be active at the same time. Because electrode driving components for driving the first electrode group and the second electrode group of the present invention can each apply voltage to plural electrodes at the same time.

In the aspect of the present invention, it is possible that absolute values of application voltages is equal between the second electrode driving component and the first electrode driving component, with polarities of the application voltages being alterable.

An image display medium which employs movements of colored particles has a higher threshold voltage for initiating particle movement than a medium which employs a liquid crystal device. Furthermore, a liquid crystal device is capable of A.C. driving because of the principle of controlling color by orientations of liquid crystals. However, in the case of changing color by moving colored particles, it is necessary to specify the direction of an electric field in accordance with the color to be displayed.

In the aspect of the present invention, it is possible that at least an orientation of the image display medium may is changeable.

In the aspect of the present invention, it is possible that the colored particles is sealed, together with a gas, between the support plates to be movable in accordance with electric fields formed between the pair of support plates, and include particle groups of a plurality of types, which differ in color and electrostatic polarity. Even with a structure with particles of two colors, plural colors are possible, and particles with the same electrostatic polarity but different colors may be mixed for mixed color displays.

In the aspect of the present invention, it is possible that the image display medium can be removably mounted at a driving device including the first electrode driving component, the second electrode driving component, the line image data generation component and the signal output destination-switching component, and mounting orientation thereof can be changed.

In the aspect of the present invention, it is possible that the image display medium is provided integrally with the first electrode driving component and the second electrode driving component, and can be removably mounted at a driving device including the line image data generation component and the signal output destination-switching component, and mounting orientation thereof can be changed.

In the aspect of the present invention, it is possible that relationship among orientations of the first electrode group and the second electrode group, the scanning direction, the first electrode driving component serving as one of a driving component for scanning and a driving component for image data and the second electrode driving component serving as the other of the driving component for scanning and the driving component for image data, is store in a storing portion, and the signal output destination-switching component outputs the first electrode designation signal to one of the first electrode driving component and the second electrode driving component, and outputs the second electrode designation signal to the other of the first electrode driving component and the second electrode driving component, on the basis of the relationship.

What is claimed is:

1. An image display device, which displays an image at an image display medium including a pair of support plates, at least one of which is transparent, a first electrode group and a second electrode group, which are provided in respective correspondence with the pair of support plates, the first electrode group including a plurality of linear first electrodes arranged side by side, and the second electrode group including a plurality of linear second electrodes arranged side by side, which intersect the first electrodes, and colored particles sealed between the pair of support plates such that states of movement of the colored particles change in accordance with electric fields formed between the pair of support plates due to voltages applied to the first electrode group and the second electrode group, the image display device comprising:

a first electrode driving component which receives an electrode designation signal, which designates an electrode belonging to the first electrode group to which voltage is to be applied, and applies voltage to the designated electrode, the first electrode driving component being capable of applying voltage to a plurality of the first electrodes of the first electrode group at the same time;

a second electrode driving component which receives an electrode designation signal, which designates an electrode belonging of the second electrode group to which voltage is to be applied, and applies voltage to the designated electrode, the second electrode driving component being capable of applying voltage to a plurality of the second electrodes of the second electrode group at the same time;

a line image data generation component to which image data of an image to be displayed at the image display medium is inputted, and which, using the image data, generates line image data for line images which are to be displayed along scan electrodes when the image of the image data is displayed by simple matrix driving, in accordance with a scanning direction when the image is displayed at the image display medium; and a signal output destination-switching component, in accordance with the scanning direction, which outputs a first electrode designation signal to one of the first electrode driving component and the second electrode driving component, for designating the scan electrode of the line at which the line image is to be displayed, and outputs a second electrode designation signal to the other of the first electrode driving component and the second electrode driving component, for designating an electrode to be driven for displaying the line image, wherein the scanning direction is changeable between a first direction and a second direction which intersect each other, wherein the signal output destination-switching component switches, based on the scanning direction, between outputting the first electrode designation signal to the first electrode driving component, and the second electrode designation signal to the second electrode driving component, when the scanning direction is along the first direction, and outputting the first electrode designation signal to the second electrode driving component, and the second electrode designation signal to the first electrode driving component, when the scanning direction is along the second direction, and wherein orientation direction information, for specifying orientation directions of the electrode groups on the support plates that are positioned at a front face side and a rear face side of the image display medium, is stored at the signal output destination-switching component, and the electrode groups to which voltages are applied on the basis of the first electrode designation signal and the second electrode designation signal are switched in accordance with the orientation direction information and the scanning direction.

2. The image display device of claim 1, wherein the line image data generation component outputs scan electrode designation information for designating the scan electrode of the line at which the line image is to be displayed, and the signal output destination-switching component outputs the first electrode designation signal on the basis of the scan electrode designation information.

3. The image display device of claim 2, wherein scanning direction designation information is stored at the signal output destination-switching component before input of the image data to the line image data generation component, the scanning direction designation information designating, in accordance with the scanning direction, which of the first electrode driving component and the second electrode driving component is the electrode driving component to which one of the first electrode designation signal and the second electrode designation signal is outputted.

4. The image display device of claim 2, wherein scanning sequence designation information, which relates to a scanning sequence of a plurality of electrodes belonging to the electrode group that is to serve as the scan electrodes, is inputted to the line image data generation component, and the scan electrode designation information is generated on the basis of the scanning sequence designation information.

5. The image display device of claim 4, wherein the scanning sequence designation information includes the scan electrode designation information, which selects a plurality of scan electrodes at the same time, and the electrode driving component, to which the first electrode designation signal in accordance with the scan electrode designation information is outputted, applies voltage to a plurality of electrodes designated by the first electrode designation signal at the same time.

6. The image display device of claim 1, wherein absolute values of application voltages are equal at the first electrode driving component and the second electrode driving component, and polarities of the application voltages are alterable.

7. The image display device of claim 1, wherein at least an orientation of the image display medium can be changed.

8. The image display device of claim 1, wherein the colored particles are sealed, together with a gas, between the support plates to be movable in accordance with electric fields formed between the pair of support plates, and form particle groups of a plurality of types, which differ in color and electrostatic polarity.

9. The image display device of claim 7, wherein the image display medium can be removably mounted at a driving device including the first electrode driving component, the second electrode driving component, the line image data generation component and the signal output destination-switching component, and mounting orientation thereof can be changed.

10. The image display device of claim 7, wherein the image display medium is provided integrally with the first electrode driving component and the second electrode driving component, and can be removably mounted at a driving device including the line image data generation component and the signal output destination-switching component, and mounting orientation thereof can be changed.

11. The image display device of claim 1, wherein the scanning direction is specified each time an image is displayed.

12. The image display device of claim 1, wherein the scanning direction is pre-specified before the line image data is generated.

13. The image display device of claim 1, wherein addressing data is generated for at least one of the first electrode driving component and the second electrode driving component on the basis of the line image data and in accordance with the scanning direction, the addressing data designating the electrodes that are to be applied voltage and a voltage application sequence of the electrodes that are to be applied voltage, and driving is performed based on the addressing data.

14. The image display device of claim 13, wherein a first addressing data is generated for the first electrode driving component on the basis of line image data and in accordance with the scanning direction, the first addressing data designating the first electrodes that are to be applied voltage and a voltage application sequence of the first electrodes that are to be applied, and a second addressing data is generated for the second electrode driving component on the basis of line image data and in accordance with the scanning direction, the second addressing data designating the second electrodes that are to be applied voltage and a voltage application sequence of the second electrodes that are to be applied.

15. The image display device of claim 14, wherein the first addressing data designates the first electrodes that are to be applied voltage by row numbers of the first electrodes of the first electrode group, and the second addressing data designates the second electrodes that are to be applied voltage by column numbers of the second electrodes of the second electrode group.

16. An image display device, which displays an image at an image display medium including a pair of support plates, at least one of which is transparent, a first electrode group and a second electrode group, which are provided in respective correspondence with the pair of support plates, the first electrode group including a plurality of linear first electrodes arranged side by side, and the second electrode group including a plurality of linear second electrodes arranged side by side, which intersect the first electrodes, and colored particles sealed between the pair of support plates such that states of movement of the colored particles change in accordance with electric fields formed between the pair of support plates due to voltages applied to the first electrode group and the second electrode group, the image display device comprising:

a first electrode driving component which receives an electrode designation signal, which designates an electrode belonging to the first electrode group to which voltage is to be applied, and applies voltage to the designated electrode, the first electrode driving component being capable of applying voltage to a plurality of the first electrodes of the first electrode group at the same time;

a second electrode driving component which receives an electrode designation signal, which designates an electrode belonging of the second electrode group to which voltage is to be applied, and applies voltage to the designated electrode, the second electrode driving component being capable of applying voltage to a plurality of the second electrodes of the second electrode group at the same time;

a line image data generation component to which image data of an image to be displayed at the image display medium is inputted, and which, using the image data, generates line image data for line images which are to be displayed along scan electrodes when the image of the image data is displayed by simple matrix driving, in accordance with a scanning direction when the image is displayed at the image display medium; and a signal output destination-switching component. in accordance with the scanning direction, which outputs a first electrode designation signal to one of the first electrode driving component and the second electrode driving component, for designating the scan electrode of the line at which the line image is to be displayed, and outputs a second electrode designation signal to the other of the first electrode driving component and the second electrode driving component, for designating an electrode to be driven for displaying the line image, wherein the scanning direction is changeable between a first direction and a second direction which intersect each other, wherein the signal output destination-switching component switches, based on the scanning direction, between outputting the first electrode designation signal to the first electrode driving component, and the second electrode designation signal to the second electrode driving component, when the scanning direction is along the first direction, and outputting the first electrode designation signal to the second electrode driving component, and the second electrode designation signal to the first electrode driving component, when the scanning direction is along the second direction, and wherein relationship among orientations of the first electrode group and the second electrode group, the scanning direction, the first electrode driving component serving as one of a driving component for scanning and a driving component for image data and the second electrode driving component serving as the other of the driving component for scanning and the driving component for image data, is store in a storing portion, and the signal output destination-switching component outputs the first electrode designation signal to one of the first electrode driving component and the second electrode driving component, and outputs the second electrode designation signal to the other of the first electrode driving component and the second electrode driving component, on the basis of the relationship.

* * * * *